US006544029B2

(12) United States Patent
Marin et al.

(10) Patent No.: US 6,544,029 B2
(45) Date of Patent: Apr. 8, 2003

(54) METHODS AND APPARATUS FOR COMBUSTION IN HIGH VOLATILES ENVIRONMENTS

(75) Inventors: Ovidiu Marin, Lisle, IL (US); Eric Streicher, Downers Grove, IL (US); Olivier Charon, Chicago, IL (US); Remi P. Tsiava, Grigny (FR)

(73) Assignees: L'Air Liquide - Societe' Anonyme A Directoire et Conseil de Surveillance pour l'Etude et l'Exploitation des Procedes Georges Claude, Paris (FR); American Air Liqude, Fremont, CA (US)

( * ) Notice: Subject to any disclaimer, the term of this patent is extended or adjusted under 35 U.S.C. 154(b) by 0 days.

(21) Appl. No.: 09/955,719

(22) Filed: Sep. 19, 2001

(65) Prior Publication Data

US 2002/0081544 A1 Jun. 27, 2002

Related U.S. Application Data

(60) Provisional application No. 60/235,684, filed on Sep. 27, 2000.

(51) Int. Cl.[7] ..... F23C 5/00; F27B 3/00

(52) U.S. Cl. ..... 431/165; 431/10; 431/159; 431/179; 431/278; 432/196

(58) Field of Search ..... 431/8, 10, 11, 431/278, 161, 165, 166, 167, 164, 174, 175, 178, 179, 159; 432/180, 196, 159; 239/588, 397.5

(56) References Cited

U.S. PATENT DOCUMENTS

| | | | | |
|---|---|---|---|---|
| 5,441,403 A | | 8/1995 | Tanaka et al. | |
| 5,975,886 A | * | 11/1999 | Philippe | 431/165 |
| 5,984,667 A | * | 11/1999 | Philippe et al. | 431/10 |
| 6,041,622 A | | 3/2000 | Duchateau et al. | |
| 6,068,468 A | | 5/2000 | Philippe et al. | |
| 6,126,438 A | * | 10/2000 | Joshi et al. | 431/10 |

* cited by examiner

*Primary Examiner*—James C. Yeung
(74) *Attorney, Agent, or Firm*—Linda K. Russell

(57) ABSTRACT

Methods and apparatus for combusting a fuel with an oxidant are described, the apparatus comprising a ceramic burner block, the burner block having a back face and a front face. The burner block has at least one oxidant cavity in an upper portion of the burner block, and at least one fuel cavity in a lower portion of the burner block, each cavity extending from the back face to the front face. The at least one oxidant cavity has positioned therein a fuel supply conduit, the fuel supply conduit having a fuel supply conduit exit positioned a sufficient distance from the front face to allow combustion of at least a portion of fuel exiting the fuel supply conduit exit with at least some of the oxidant traversing the oxidant cavity, and the least one fuel cavity having connected thereto, near the back face, an oxidant conduit, thereby allowing mixing of a minor portion of the oxidant with the fuel.

12 Claims, 2 Drawing Sheets

METHODS AND APPARATUS FOR COMBUSTION IN HIGH VOLATILES ENVIRONMENTS

CROSS REFERENCE TO RELATED APPLICATION

This application is related to co-pending provisional patent application Ser. No. 60/235,684, filed Sep. 27, 2000, which is incorporated by reference in its entirety.

BACKGROUND OF THE INVENTION

1. Field of the Invention

The present invention relates in general to combustion methods and apparatus, and in particular, to methods and apparatus for combusting a fuel with an oxidant, preferably an oxygen-enriched oxidant, in high particulate and/or high volatiles environments.

2. Related Art

Combustion burners of the type illustrated in U.S. Pat. Nos. 5,975,886 and 6,068,468, known under the trade designation "ALGLASS FC" ™ have been highly successful in design and are in operation worldwide in a multitude of glass furnaces for producing glass items. However, end users and combustion scientists are always seeking improvements. In certain targeted extreme conditions, where the glass furnace combustion environment is characterized by a large amount of volatiles, the volatiles can cause problems in operation of the burners. For example, the volatiles leave the glass batch in a gaseous form, together with additional particulates entrained in the gas space of the furnace. The volatiles are typically brought into contact with a furnace crown, where they condense, due to the colder wall temperature, and eventually run down the crown back into the molten glass batch. When a relatively colder fluid stream of oxidant and/or fuel comes in contact with a liquid phase falling down the furnace wall, the relatively colder fluid stream promotes solidification of the liquid phase, leading to the gradual obstruction of burner orifices. This in turn may lead to a deterioration of the combustion process, and finally to block/burner tip damage. The condensation of the particulate, volatile matter may also produce block corrosion, particularly at low temperatures.

The patterns described above are primarily above the molten batch area. Further downstream in the glass furnace, particularly those with high volatile content, the volatiles close to the burner are recirculated toward the burner, where they will typically condense on the front face of the burner, and then solidify in the proximity of cold spots on the front face of the burner.

FIG. 1 illustrates schematically a temperature profile for a conventional burner block 1 available from Air Liquide under the trade designation ALGLASS FC™, as predicted by Fluent computational fluid dynamics (CFD) software. In this simulation, a major portion of total oxygen was injected at ambient temperature, and exited through two upper orifices, 3(*a*) and 3(*b*), heated only by the warm burner block. In this simulation, a fuel, natural gas, was injected in the burner and exits three lower orifices 5(*a*), 5(*b*), 5(*c*). The front face of the burner block is designated as 20. It is noted that the temperature of front face 20 around the oxygen injectors and in some areas around the left-most fuel injector 5(*c*) was significantly lower than the temperature elsewhere on the face of the burner block. This is indicated by the hatched areas 7 in FIG. 1. The computer simulation indicated that the area 7 had the lowest temperature on the front face 20 of burner block 1, this temperature being around 800K. This temperature is well below solidification temperature of glass, and is also much lower than the solidification temperature of volatile matter in the combustion environment above the glass.

In FIG. 1, the two orifices 3(*a*) and 3(*b*) supplied the bulk of the oxygen necessary to combust the natural gas exiting orifices 5(*a*), 5(*b*) and 5(*c*). The gas exiting the three natural gas orifices 5(*a*), 5(*b*) and 5(*c*) contained, besides the natural gas fuel, from about 5 to about 20% of the total oxygen as well, allowing for some combustion to be initiated in the burner block. Thus, as predicted by this simulation, the temperature of the burner block/gas mixture at the fuel injector level was significantly higher, and the solidification process noted at the oxidant injector level was not observed.

FIG. 1 also illustrates an interesting phenomenon, namely the non-symmetry of the flow out of the symmetrical burner block. While the two oxygen orifices 3(*a*) and 3(*b*), and the three natural gas orifices 5(*a*), 5(*b*), and 5(*c*) were placed symmetrically, it should be noted that the left-hand side of the burner face 20 was colder when compared to the right-hand side. This trend was attributed to the slightly non-symmetrical combustion chamber, leading to different flow patterns in the combustion chamber. This observation is validated in the field, where the different injectors display different flame/flow patterns.

It would be an advance in the burner art if burner operation could be improved in high particulate, and/or high volatiles environments to prevent solidification of the particulates and/or volatiles on the face of the burner blocks.

SUMMARY OF THE INVENTION

A first aspect of the invention is an apparatus for combusting a fuel with an oxidant, the apparatus comprising:

(a) a ceramic burner block, the burner block having a back face and a front face, the burner block having at least one oxidant cavity in an upper portion of the burner block, and at least one fuel cavity in a lower portion of the burner block, each cavity extending from the back face to the front face; and (b) the at least one oxidant cavity having positioned therein a fuel supply conduit, the fuel supply conduit having a fuel supply conduit exit positioned a sufficient distance from the front face to allow combustion of at least a portion of fuel exiting the fuel supply conduit exit with at least some of the oxidant traversing the oxidant cavity, and the least one fuel cavity having connected thereto, near the back face, an oxidant conduit, thereby allowing mixing of a minor portion of the oxidant with the fuel.

Preferred are apparatus of the invention wherein the fuel supply conduit is connected near the back face to a fuel supply manifold; apparatus wherein the at least one fuel cavity is connected near the back face to a fuel supply manifold; and apparatus wherein the at least one fuel cavity is connected near the back face to the fuel supply manifold.

Particularly preferred apparatus of the invention are those having two oxidant cavities positioned in the upper portion of the burner block, and three fuel cavities positioned in the lower portion of the burner block, wherein each of the two oxidant cavities has positioned therein one of the fuel supply conduits.

A second aspect of the invention is a method of combusting a fuel with an oxidant, the method comprising the step of supplying the apparatus of the invention with a fuel and an oxidant, at least a portion of a total amount of the oxidant routed to the fuel supply cavity, and at least a portion of the fuel routed to the oxidant cavity.

Preferred are methods of combusting a fuel with an oxidant, wherein a major portion of the fuel is supplied in three fuel cavities, and a major portion of oxidant is supplied via two oxidant cavities.

A third aspect of the invention is a method of heating a charge in a high volatiles environment, the method comprising the steps of supplying an apparatus of the invention with a fuel and an oxidant, at least a portion of a total amount of the oxidant routed to the at least one fuel cavity, and at least a portion of a total amount of the fuel is routed to the at least one oxidant cavity.

Preferred are methods of heating a charge in a high volatiles environment, wherein a major portion of the fuel is supplied in three fuel cavities, and a major portion of oxidant is supplied via two oxidant cavities.

Also preferred are methods wherein there are a plurality of burner blocks, each of the burner blocks spaced apart by a distance D, and wherein there is positioned an oxygen lance a distance of approximately one-half D and positioned between each of the plurality of burner blocks.

Further understanding of the invention may be had by review of the following description and claims.

DESCRIPTION OF PREFERRED EMBODIMENTS

The term "fuel", according to this invention, means, for example, methane, natural gas, liquefied natural gas, propane, atomized oil or the like (either in gaseous or liquid form) at either room temperature (about 25° C.) or in preheated form. The term "oxidant", according to the present invention, means a gas containing oxygen that can support combustion of the fuel. Such oxidants include air, oxygen-enriched air containing at least 50% vol. oxygen such as "industrially" pure oxygen (99.5%) produced by a cryogenic air separation plant, or non-pure oxygen produced for example by a vacuum swing adsorption process (about 88% vol. oxygen or more) or "impure" oxygen produced from air or any other source by filtration, adsorption, absorption, membrane separation, or the like, at either room temperature or in preheated form. It is also important to note that, although in most instances it is preferred that the oxidants be the same in chemical composition, the oxidant flowing into the oxidant cavities and the oxidant mixed with the fuel in the fuel cavities could be different. That is, the oxidant mixing with fuel in the fuel cavities could be oxygen-enriched air, while the oxidant traversing the oxidant cavities is industrially pure oxygen, or vice versa.

Figure 2:
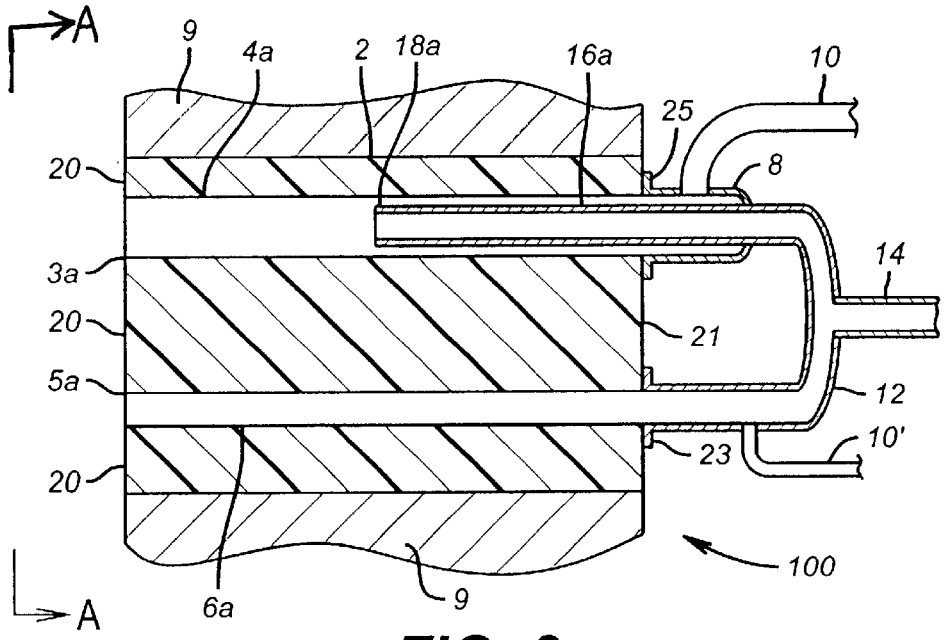
FIG. 2 illustrates a side-sectional view of one preferred burner apparatus in accordance with the present invention.
Figure 3:
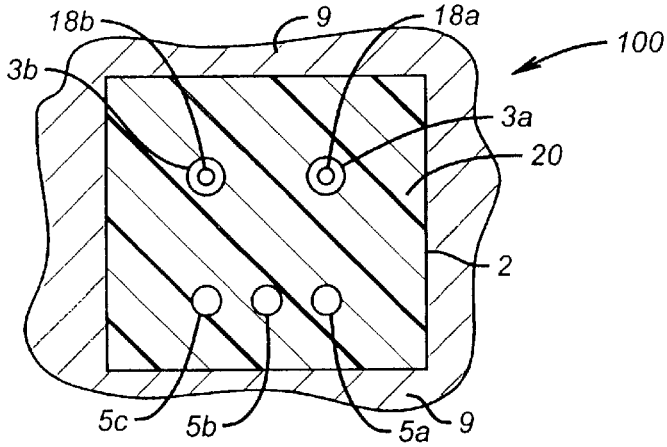
FIG. 3 is a front elevation view of the burner of FIG. 2 viewed from the view A—A illustrated in FIG. 2.

Referring now to the FIGS., FIGS. 2 and 3 represent cross-section and front elevation views, respectively, of a preferred burner apparatus 100 in accordance with the present invention. A burner block 2 is illustrated positioned within a furnace wall 9. Burner block 2 is typically ceramic in nature, and may utilize materials described in the aforementioned U.S. Patent Nos. 5,975,886 and 6,068,468, both incorporated herein by reference in their entirety. Burner block 2 comprises an oxidant cavity 4(*a*) and a fuel cavity 6(*a*), which are shown substantially parallel in the embodiments of FIGS. 2 and 3, but may actually be angled towards each other in certain preferred embodiments. This angling together may be desired, for example, when the combustion space is not large, or when it is desired to direct the flame away from a furnace drown or other structure. Oxidant cavity 4(*a*) traverses burner block 2 from a hot front end 20 back to a cold or back end 21. Similarly, the fuel cavity 6(*a*) traverses from front faced 20 to back face 21. Oxidant cavity 4(*a*) is preferably flared outward as shown at oxidant cavity exit orifice 3(*a*), and similarly fuel cavity 6(*a*) is preferably flared outward at a fuel exit orifice 5(*a*). Oxidant is preferably supplied to oxidant cavity 4(*a*) via a connection 8 and plate 10 in any fashion common to the art. Similarly fuel is preferably supplied to cavity 6(*a*) via a conduit 12 and main conduit 14. Conduit 10' supplies from about 5 to about 20% of total oxidant. Conduit 10' may connect to conduit 10 in a common manifold (not shown). As noted previously, however, this is only preferred; in other embodiments it may be preferable to have two different oxidants, and/or two different fuels. In these cases the conduit arrangements are obviously changed slightly to accommodate those desires.

A key feature of the invention is the provision of a fuel supply conduit 16*a* in the oxidant cavity 4(*a*). Fuel supply conduit 16*a* terminates in a fuel supply conduit exit 18(*a*) which is recessed away from front face 20 of burner block 2 by a distance; sufficient to combust at least a portion of the fuel exiting fuel supply conduit 16*a* as it mixes with a major portion of oxidant flowing through cavity 4(*a*). In preferred embodiments, fuel supply conduit 16*a*, conduit 12 and fuel supply conduit 14 are all one piece, and connected to the burner block via bolted flanges or other fasteners depicted at 23, which are common in the art and need no further explanation. Similarly, oxidant manifold 8 is connected to burner block 2 via fasteners 25, also in known fashion.

As illustrated in FIG. 3, preferably there are two oxidant cavities having exit orifices 3(*a*) and 3(*b*) in an upper portion of burner block 2, and three fuel supply cavities in a lower portion of the burner block, having exit orifices illustrated at 5(*a*), 5(*b*) and 5(*c*). Fuel supply conduits 16(*a*) (not shown), 16(*b*) (not shown) have exits 18(*a*) and 18(*b*) that are illustrated positioned within oxidant supply cavities 3(*a*) and 3(*b*), respectively.

Figure 1:
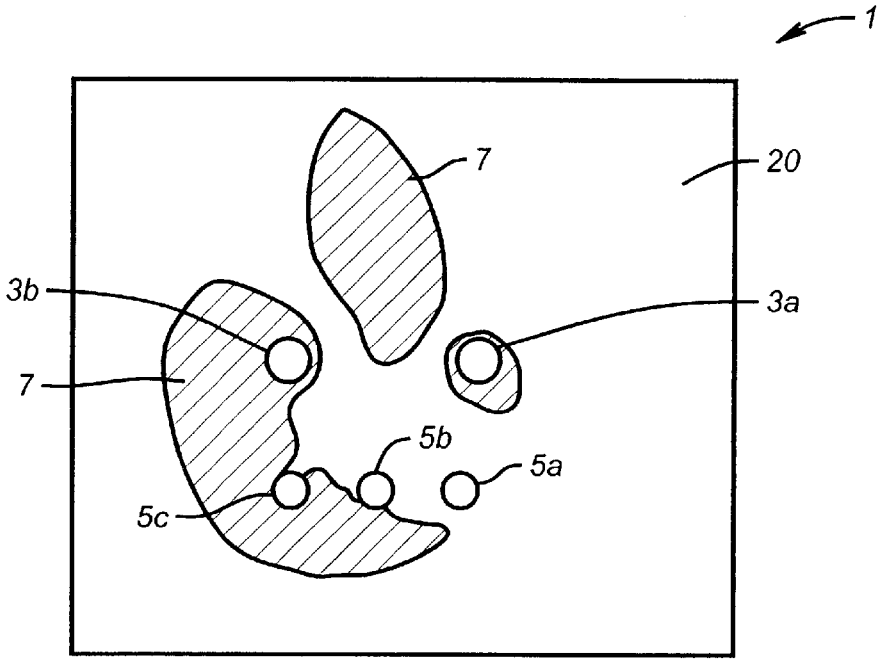
(PRIOR ART) FIG. 1
FIG. 1 illustrates a front elevation view of a prior art burner apparatus, illustrating "cold areas"
Figure 5:
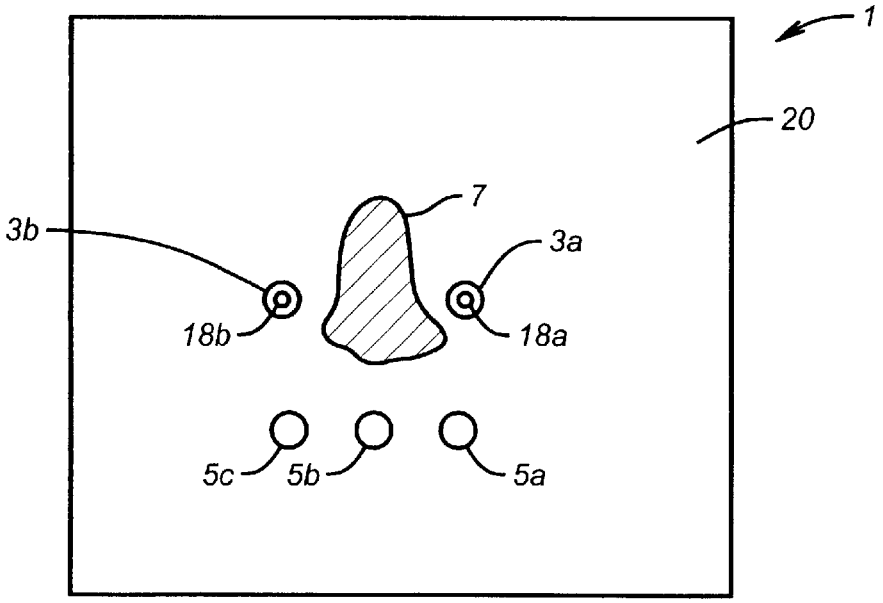
FIG. 5 is a front elevation view of the burner of FIG. 3 of the invention, illustrating reduced cold areas.

FIG. 5 illustrates, in comparison with the prior art of FIG. 1, a reduction in cold area as predicted by Fluent computational fluid dynamic software. As can be seen, the area 7 which is a reduced temperature and which is able to condense volatile, particulate matter within a combustion area of a glass tank furnace for example, is much smaller than the area 7 of similar temperature depicted in FIG. 1. FIG. 5 illustrates the temperature profile at the burner block level when the major portion of oxidant is heated by virtue of combustion of a portion of the oxidant with fuel prior to its being injected in the combustion chamber. The results in FIG. 5 simulated an operation where approximately 10% of the total fuel was supplied to oxygen cavities 4(*a*) and 4(*b*), thus some combustion did occur in the burner block in the oxidant cavities.

Several trends can be observed from FIG. 5. For example, the temperature of the burner block is elevated at many more points on the front face 20, indicating a reduced risk for solidification of the liquid run down in the burner area, or of the condensate further downstream in the furnace. Secondly, the temperature profile at the burner block level is more symmetrical than in FIG. 1, although the overall flow rates are approximately the same as in the simulation depicted in FIG. 1. This trend is attributed to the higher velocities of the partially used oxygen flowing out of the oxygen cavities (due to elevated temperature, and thus decreased density), trending to a stronger recirculation of the flue gases in the vicinity of burner front face 20. This trend may further enhance the overall burner operation when the oxidant penetrates further into the combustion space in preheated fashion.

The practice of apparatus and methods of invention reduces or eliminates the problems of the prior art burner, namely the reduction or removal of the cold spots on the front face of the burner block. As illustrated in relation to FIG. 1, these cold spots lead to possible change of state (namely solidification) of the liquid run-down in the furnace, for high-volatile combustion environments such as glass tank furnaces. The cold spots occurring near the exits of the oxidant injectors are removed or substantially reduced by introducing from about 5 to about 20% of the total fuel supplied to the burner into the oxidant cavities, as depicted in FIGS. 2 and 3. In a preferred embodiment, one fuel conduit is introduced in each of two separate oxidant cavities, carrying a portion of the fuel into the burner block. These fuel conduits will deliver fuel in the oxidant cavities, and the combustion process will be initiated within the oxidant cavities of the burner block in, in contrast to known burners. The combustion process, when completed, will lift the mixture temperature to a level close to the burner block temperature, such that the cold spots experienced with previous burner configurations will be significantly reduced or avoided entirely.

One preferred embodiment of the burner apparatus of the invention, termed the ALGLASS FC-HVTM™ burner, is illustrated in FIG. 2, wherein the fuel conduits all originate in a single supply line or manifold 12 and supply conduit 14. This is the least expensive design to produce and easiest to install. Burners such as those described herein have been tested in borosilicate glass production furnaces having high volatile environments and have provided enhanced operation of oxy-fuel burners in such environments.

Figure 4:
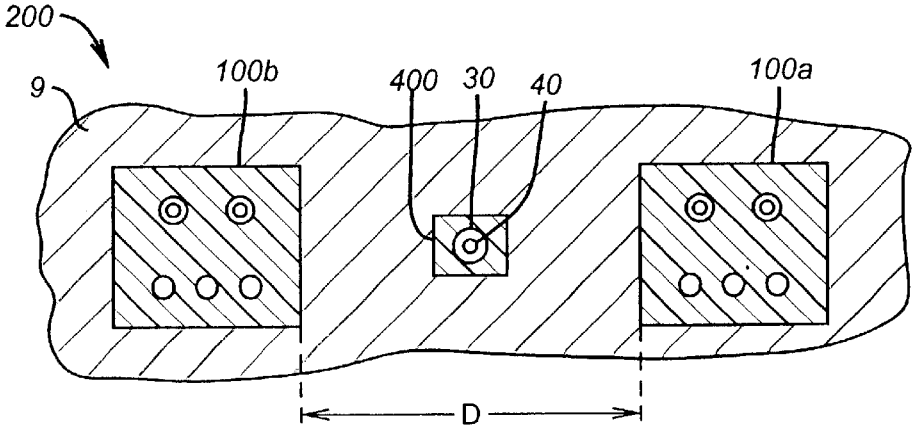
FIG. 4 is a front elevation view of another burner embodiment of the invention.

Another embodiment of the invention is depicted in FIG. 4, where the invention is extended to oxidant lances, which are extensively used in multiple industrial applications. The addition of from about 5 to about 20% fuel to an oxidant lance will not only avoid cold spots on the front face of the lance, but will also increase the momentum of the oxidant, due to its increased temperature. A variation of ratio of oxidant to fuel will allow variation of the momentum of the gases exiting the lance, thus allowing optimization of the process downstream of the apparatus.

FIG. 4 illustrates one embodiment of the extension of the invention to an oxidant lance. In the embodiment illustrated in FIG. 4, two burners of the type 100 illustrated in FIGS. 2 and 3 are separated by a suitable distance D, and in FIG. 4 depicted as burners 100(*a*) and 100(*b*). Approximately midway between burners 100(*a*) and 100(*b*) is positioned an oxygen lance 400, having an oxidant cavity 30 and a fuel conduit 40 positioned therein. The arrangement is depicted in FIG. 4 as a system 200, all connected via a furnace wall 9, although this is not necessarily required to practice the invention. For example, two burners 100(*a*) and 100(*b*) could be positioned within a furnace wall 9, and the oxidant lance with fuel supply 400 could simply be a concentric or non-concentric pipe-in-pipe arrangement.

The fuels that may be used in practicing the apparatus and methods of invention include both gaseous and liquid fuels, and may even include solid fuels to the extent that the solid fuels are able to fuel through the fuel conduits. Preferred fuels include natural gas and atomized oil using oil atomization means, for example as depicted in U.S. Pat. No. 5,833,447, which is incorporated herein by reference.

The invention is not limited to the apparatus and methods particularly disclosed herein and those skilled in the art will recognize variations within the following claims that the inventor intends to be within these claims.

What is claimed is:

1. An apparatus for combusting a fuel with an oxidant, the apparatus comprising:

(a) a ceramic burner block, the burner block having a back face and a front face, the burner block having at least one oxidant cavity in an upper portion of the burner block, and at least one fuel cavity in a lower portion of the burner block, each cavity extending from the back face to the front face; and (b) the at least one oxidant cavity having positioned therein a fuel supply conduit, the fuel supply conduit having a fuel supply conduit exit positioned a sufficient distance from the front face to allow combustion of at least a portion of fuel exiting the fuel supply conduit exit with at least some of the oxidant traversing the oxidant cavity, and the least one fuel cavity having connected thereto, near the back face, an oxidant conduit, thereby allowing mixing of a minor portion of the oxidant with the fuel.

2. The apparatus of claim 1 wherein said fuel supply conduit is connected near the back face to a fuel supply manifold.

3. The apparatus of claim 2 wherein said at least one fuel cavity is connected near the back face to said fuel supply manifold.

4. The apparatus of claim 1 wherein said at least one fuel cavity is connected near the back face to a fuel supply manifold.

5. The apparatus of claim 1 having two oxidant cavities positioned in the upper portion of said burner block, and three fuel cavities positioned in the lower portion of said burner block, wherein each of said two oxidant cavities has positioned therein one of said fuel supply conduits.

6. A method of heating a charge in a high volatiles environment, the method comprising the step of supplying the apparatus of claim 5 with a fuel and an oxidant, at least a portion of a total amount of said oxidant routed to the at least one fuel cavity, and at least a portion of the fuel routed to the at least one oxidant cavity.

7. A method of combusting a fuel with an oxidant, said method comprising the step of supplying the apparatus of claim 1 with a fuel and an oxidant, at least a portion of a total amount of said oxidant routed to said at least one fuel cavity, and at least a portion the fuel routed to the at least one oxidant cavity.

8. The method of claim 7 wherein there is a plurality of said burner blocks, each of said burner blocks spaced apart by a distance D.

9. The method of claim 8 wherein there is positioned an oxygen lance positioned between each of said plurality of said burner blocks.

10. The method of claim 9 wherein there is positioned an oxygen lance a distance of approximately one-half D and positioned between each of said plurality of said burner blocks.

11. A method of combusting a fuel with an oxidant, said method comprising the step of supplying the apparatus of claim 1 with a fuel and an oxidant, wherein a major portion of said fuel is supplied in three fuel cavities, and a major portion of said oxidant is supplied in two oxidant cavities.

12. A method of heating a charge in a high volatiles environment, the method comprising the step of supplying the apparatus of claim 1 with a fuel and an oxidant, at least a portion of a total amount of said oxidant routed to the at least one fuel cavity, and at least a portion the fuel routed to the at least one oxidant cavity.

* * * * *